US012727638B2

(12) United States Patent
Bain

(10) Patent No.: US 12,727,638 B2
(45) Date of Patent: Sep. 8, 2026

(54) METHOD FOR SECURING A CAP ON A HEAD

(71) Applicant: Ross William Bain, North Ipswich (AU)

(72) Inventor: Ross William Bain, North Ipswich (AU)

( * ) Notice: Subject to any disclaimer, the term of this patent is extended or adjusted under 35 U.S.C. 154(b) by 0 days.

(21) Appl. No.: 19/282,306

(22) Filed: Jul. 28, 2025

(65) Prior Publication Data

US 2025/0351914 A1 Nov. 20, 2025

Related U.S. Application Data

(62) Division of application No. 17/830,103, filed on Jun. 1, 2022, now abandoned.

(51) Int. Cl.
*A42B 7/00* (2006.01)
*A42B 1/0182* (2021.01)

(52) U.S. Cl.
CPC ..... *A42B 7/00* (2013.01); *A42B 1/0182* (2021.01)

(58) Field of Classification Search
CPC ..... A42B 7/00; A42B 1/0145; A42B 1/22; A42B 1/06; A42B 1/0186; A42C 5/00; A42C 5/02; A42C 5/04
USPC ..... D2/874, 894, 891, 881
See application file for complete search history.

(56) References Cited

U.S. PATENT DOCUMENTS 714,198 A * 11/1902 Lacy ..... A42B 7/00 132/59
1,354,892 A * 10/1920 Dales ..... A42B 7/00 2/181
1,482,261 A * 1/1924 Rubenstein ..... A42B 7/00 132/59
1,497,901 A * 6/1924 Greenberg ..... A42B 7/00 132/59
1,513,632 A * 10/1924 Saxton ..... A42C 5/04 2/209.5
1,566,891 A * 12/1925 Lyon ..... A42B 7/00 2/181.2
1,685,263 A * 9/1928 Wolff ..... A42B 7/00 132/58
1,894,213 A * 1/1933 Ostolaza ..... A42C 5/04 2/182.1
1,992,285 A * 2/1935 Blum ..... A42B 1/22 2/183
2,121,973 A * 6/1938 Lipton ..... A42B 7/00 132/58
2,286,202 A * 6/1942 Fischer ..... A42B 1/0182 D2/893

(Continued)

*Primary Examiner* — Heather Mangine
(74) *Attorney, Agent, or Firm* — Eric Karich; Karich & Associates

(57) ABSTRACT

A method of securing a wind resistant cap on a head of a user includes the steps of first providing a wind resistant cap that comprises a cap body having a brim and an inner circumference that includes a front portion adjacent the brim, a rear portion, and opposing sides. A securing strap has a strap body that extends to ends each attached to one of the opposing sides of the inner circumference of the cap body. The cap body is positioned on the head such that the strap body is positioned across the forehead of the user. When the wind resistant cap is subjected to wind, the securing strap remains secured across the forehead of the user to retain the cap body so that it is not blown off the user's head.

1 Claim, 3 Drawing Sheets

(56) References Cited

U.S. PATENT DOCUMENTS 2,339,077 A * 1/1944 Hoffeld ..... A42B 7/00 132/58
2,420,937 A * 5/1947 Dauster ..... A42B 3/14 2/419
3,109,176 A * 11/1963 Schuessler ..... A42B 7/00 D2/889
4,131,953 A * 1/1979 Kimotsuki ..... A42B 1/205 2/171.1
4,274,157 A * 6/1981 Boden ..... A42C 5/04 2/181.4
4,642,817 A * 2/1987 Ferstenfeld ..... A42B 1/22 2/DIG. 11
4,845,782 A * 7/1989 Gregg ..... A42B 7/00 2/172
D309,523 S * 7/1990 Martin ..... D2/894
4,941,210 A * 7/1990 Konucik ..... A41D 27/13 2/195.3
4,989,270 A * 2/1991 Boughten ..... A42B 1/006 2/171.7
4,993,079 A * 2/1991 Johnson ..... A42B 7/00 2/418
4,999,846 A * 3/1991 Ball ..... A42B 1/22 2/418
5,144,695 A * 9/1992 Schweizer ..... A42B 3/08 2/209.13
5,313,668 A * 5/1994 Bogan ..... A42C 5/02 2/209.13
5,432,955 A * 7/1995 Plotka ..... A42C 5/02 2/209.12
D365,917 S * 1/1996 Armstrong ..... D2/881
5,495,622 A * 3/1996 Kaufman ..... A42C 5/04 2/209.5
5,548,846 A * 8/1996 Bianchetti ..... A42B 1/0184 2/209.12
5,611,118 A * 3/1997 Bibbee ..... A42B 7/00 24/712
5,676,449 A * 10/1997 Newsome ..... F21L 2/00 362/396
5,802,617 A * 9/1998 Boden ..... A42C 5/04 2/181.2
5,855,023 A * 1/1999 Clingenpeel ..... A42C 5/04 2/209.5
5,887,284 A * 3/1999 Simmons ..... A42C 5/02 2/184
D416,665 S * 11/1999 Jones ..... D2/881
5,978,968 A * 11/1999 Lee ..... A42B 1/002 2/182.2
6,122,774 A * 9/2000 Park ..... A42B 1/22 2/181.2
6,240,570 B1 * 6/2001 Wu ..... A42B 1/08 2/DIG. 1
6,345,395 B1 * 2/2002 Chilton ..... A42B 1/12 2/202
6,442,762 B1 * 9/2002 Neumann ..... A42B 7/00 132/58
6,446,265 B1 * 9/2002 Moreau ..... A42B 7/00 2/175.7
6,467,096 B1 * 10/2002 Coluccio ..... A42B 1/22 2/195.2
6,553,577 B2 * 4/2003 Montague ..... A42B 1/04 2/175.2
7,082,620 B1 * 8/2006 Rongione ..... A42B 7/00 2/418
7,665,154 B2 * 2/2010 Gerstel Costello .... A42B 1/225 2/195.3
7,774,861 B1 * 8/2010 Schmidt ..... A42C 5/02 2/181.2
7,882,572 B2 * 2/2011 Wong ..... A42C 5/02 2/181.6
8,375,469 B2 * 2/2013 Duwyn-Zylstra ..... A42B 1/206 2/209.12
8,393,014 B1 * 3/2013 Follo ..... A42C 5/02 2/181
9,220,308 B2 * 12/2015 Boyle ..... A42C 5/02
9,307,799 B2 * 4/2016 Heard ..... A42B 1/22
10,143,254 B2 * 12/2018 Hawes ..... A42B 1/245
11,172,724 B2 * 11/2021 Niedermeyer ..... A42B 1/02
11,497,268 B2 * 11/2022 Shaw ..... A42B 1/206
11,576,453 B2 * 2/2023 Sunseri ..... A42B 1/22
2002/0029404 A1 * 3/2002 Friedman ..... A42B 1/22 2/195.2
2002/0162157 A1 * 11/2002 Hoyez ..... A42B 1/225 2/171
2002/0162160 A1 * 11/2002 Anderson ..... A42B 1/22 2/200.1
2003/0037365 A1 * 2/2003 Wilson ..... A42B 1/22 2/181
2004/0003450 A1 * 1/2004 Wang ..... A42B 1/22 2/181
2006/0272074 A1 * 12/2006 Fouts ..... A42B 7/00 2/175.7
2012/0198600 A1 8/2012 Niazi
2014/0053317 A1 * 2/2014 Haroutoonian ..... A42B 1/22 2/195.3
2014/0115752 A1 * 5/2014 Ryan ..... A42B 7/00 2/243.1
2015/0150328 A1 * 6/2015 Knight ..... A42C 5/04 2/175.1
2016/0128417 A1 * 5/2016 Hickey ..... A42B 1/0182 2/195.1
2017/0258165 A1 * 9/2017 Thornton ..... A42C 5/02
2018/0007995 A1 * 1/2018 Morales ..... A41D 1/04
2018/0140033 A1 * 5/2018 Thornton ..... A42B 1/0182
2019/0183201 A1 * 6/2019 Defino ..... A42B 1/248
2019/0223538 A1 * 7/2019 Berg ..... A47H 13/00
2020/0068974 A1 * 3/2020 Schlabach ..... A42B 7/00
2020/0214382 A1 * 7/2020 Dann ..... A42B 1/225
2021/0145108 A1 * 5/2021 Starks ..... A42C 5/04
2021/0259345 A1 * 8/2021 Michaels ..... A42B 1/22
2021/0392990 A1 * 12/2021 Carmichael ..... A42C 5/00
2022/0295930 A1 * 9/2022 Saadi, Jr. ..... A42C 5/00
2023/0389644 A1 * 12/2023 Bain ..... A42B 1/0182

* cited by examiner

METHOD FOR SECURING A CAP ON A HEAD

CROSS-REFERENCE TO RELATED APPLICATIONS

This application for a utility patent is a divisional application of a previously filed utility patent, still pending, having the application Ser. No. 17/830,103, filed Jun. 1, 2022.

BACKGROUND OF THE INVENTION

Field of the Invention

This invention relates generally to caps, and more particularly to a method for securing a cap on a head.

Description of Related Art

Caps having brims, commonly called baseball caps, are frequently used in many outdoor and sporting settings, including boating, fishing, waterskiing, and other water related sports, as well as other sports that don't involve water. Wearing a cap in such a setting, especially while over the water in particular, can be a problem while wearing such caps, because the wind can blow the cap from the user's head, and it may be lost, particularly if lost into the water.

There is a long felt need in this field for a cap that is resistant to be being blown off the user's head. The present invention fulfills these needs and provides further advantages as described in the following summary.

SUMMARY OF THE INVENTION

The present invention teaches certain benefits in construction and use which give rise to the objectives described below.

The present invention provides a method of securing a wind resistant cap on a head across a forehead of a user. The method comprises a first step of providing a wind resistant cap comprising a cap body having a brim extending outwardly from the cap body, the cap body having an inner circumference that includes a front portion adjacent the brim, a rear portion, and opposing sides. A securing strap has a strap body that extends to ends each attached to one of the opposing sides of the inner circumference of the cap body, such that the strap body extends across the front portion of the inner circumference of the cap body. At a next step, the cap body is positioned on the head of the user such that the strap body is positioned across the forehead of the user. At a next step, the wind resistant cap is subjected to wind sufficient to blow the cap body off the user's head, but wherein the securing strap remains secured across the forehead of the user to retain the cap body so that it is not blown off the user's head.

A primary objective of the present invention is to provide a method having advantages not taught by the prior art.

Another objective is to provide a method for retaining a wind resistant cap on a user's head.

A further objective is to provide a method that utilizes a wind resistant cap having a securing strap for retaining the cap on a user's head.

A further objective is to provide a method that utilizes a wind resistant cap having a securing strap that is inelastic, so that it does not stretch when subjected to wind forces, thereby enabling the cap to remain on the user's head.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a method for preventing a cap from being blown off a user's head, the method utilizing a wind resistant cap that includes a securing strap.

Figure 1:
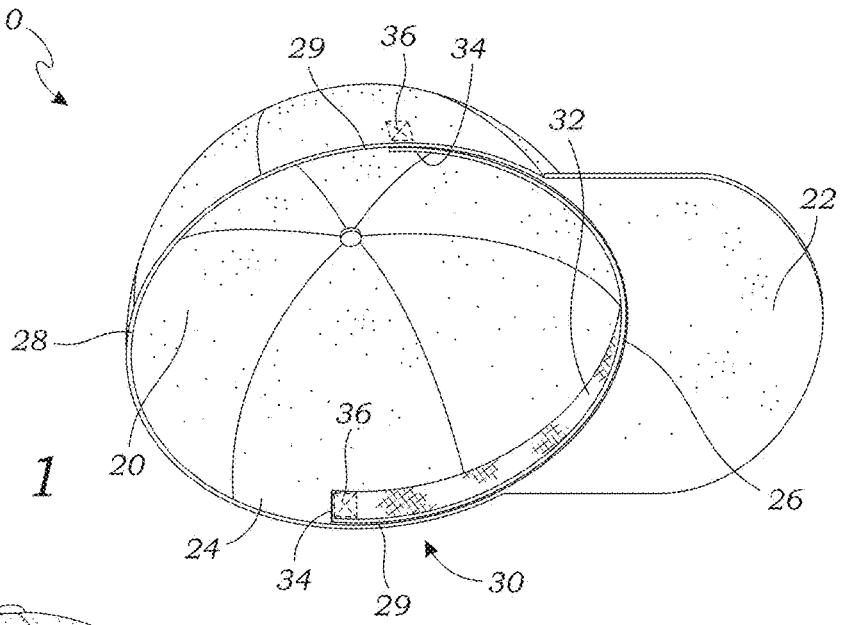
FIG. 1 is a bottom perspective view of a wind resistant cap according to one embodiment of the present invention, and illustrating a securing strap having a fixed fastener.

FIG. 1 is a perspective view of a wind resistant cap 10 according to one embodiment of the present invention. As shown in FIG. 1, the wind resistant cap 10 comprises a cap body 20 having a brim 22 extending outwardly from the cap body 20, and further includes a securing strap 30 for preventing the cap from being blown off the user's head. The securing strap 30 that extends entirely across a front portion 26 of the inner circumference of the cap body 20 and across the entirety of a width of the brim 22. The securing strap 30 is configured to be positioned across the forehead of a user and to retain the cap body 20 on the user's head when subjected to wind forces.

The wind resistant cap 10 illustrated in this embodiment is in the form of a baseball cap, but it may be implemented in any form of cap that includes a brim extending at least partially from the cap. The cap body 20 may typically be constructed primarily of cloth/fabric material, though additional or alternative materials may be used for different embodiments, as deemed suitable by one skilled in the art. The cap body 20 may be provided in a range of different heights, flexibility options, and shapes, which is not limited to the embodiment described herein.

As illustrated, in this embodiment, the cap body 20 comprises an inner circumference 24 that includes a front portion 26 that is typically worn to the front of the user, adjacent the brim 22. The inner circumference 24 further includes a rear portion 28 opposite the front portion 26, and opposing sides 29 that extend between the front and the back. While one example is shown and discussed herein, the inner circumference 24 of the cap body 20 may be provided in a variety of different sizes and dimensions, i.e., for differently sized heads or for stylistic purposes. In some embodiments, the rear portion 28, or other suitable portion, may include an adjustment strap (not shown), or other adjustment means, for adjusting the inner circumference 24, as is well-known in the art. Furthermore, the rear portion 28 and/or opposing sides 29 may extend downwardly past the brim 22 as in an aviator hat or similar, or they may be instead be generally level with the brim 22, or the brim 22 may angle more downwardly than the inner circumference 24.

In some embodiments, the brim 22 may be fixedly attached to the cap body 20, or it may be removable, wherein the user may optionally wear the cap 20 with the brim 22 and/or securing strap 30. The brim 22 may be different dimensions than illustrated, i.e., being wider, longer, more or less curved, etc. The brim 22 may be constructed of the same material as the cap body 20, or a different rigid or semi-rigid material. Other features known to be included in prior art caps may also be included, e.g., ornamental features, inner lining, structural reinforcements, etc., provided they are within the scope of the claims of the present invention.

Figure 5:
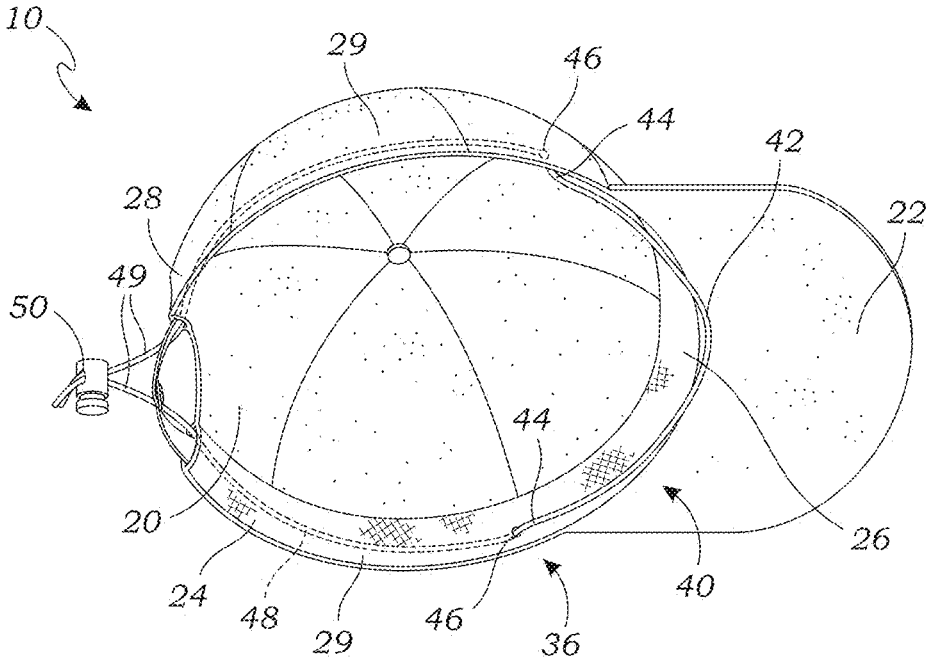
FIG. 5 is a bottom perspective view of a third embodiment of the wind resistant cap, showing an alternative embodiment of the securing strap.
Figure 6:
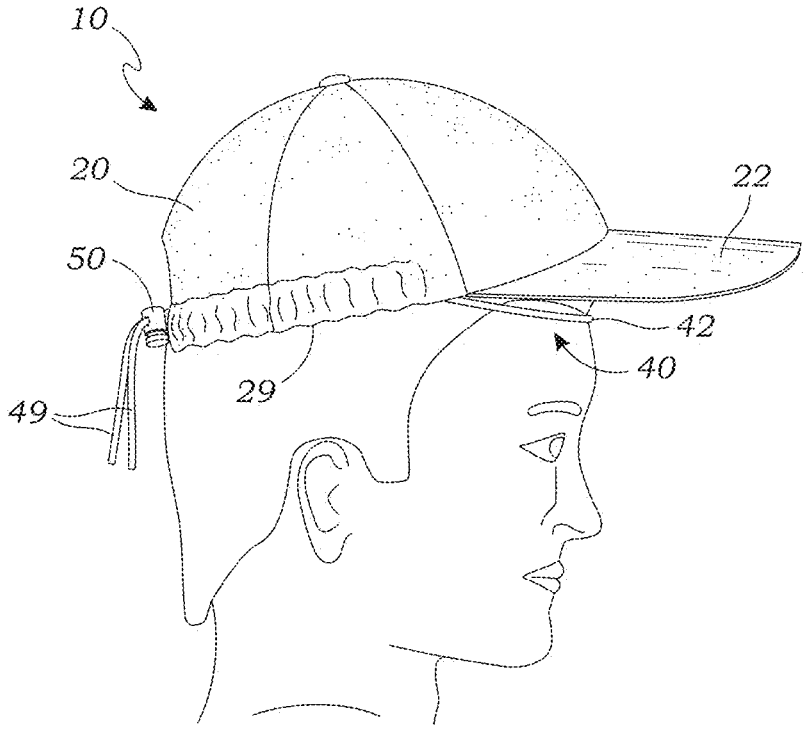
FIG. 6 is a side elevational view of a person wearing the wind resistant cap of FIG. 5, with the alternative securing strap tightened around the person's head.

As shown in FIG. 1, the securing strap 30 is attached to the inner circumference 24 of the cap body 20, wherein the strap body directly abuts the front portion 26 of the inner circumference 24, making contact along the inner edge of the cap body 20. In this embodiment, the securing strap 30 comprises a strap body 32 that extends to ends 34, wherein each end 34 is attached to one of the opposing sides 29 of the inner circumference 24 of the cap body 20, such that the strap body 32 extends across the front portion 26 of the inner circumference 24 of the cap body 20. An alternative example of the securing strap 30 is also shown in FIGS. 5-6 and discussed below.

In some embodiments, the ends 34 of the strap body 32 include a fastener 36 for fastening the securing strap 30 to the cap body 20. As shown in FIG. 1, the fastener 36 may be in the form of stitching, but in other embodiments the fastener 36 may be another type of fixed fastener (e.g., studs, an adhesive, links, etc.), or the fastener 36 may be a removable fastener, one example being shown in FIG. 4 and discussed further below.

In some embodiments, the strap body 32 may be fully or partially constructed of an elasticized material, so there is some give when the cap body 20 is pulled away from the head, shown in FIG. 3 and discussed below. However, in other embodiments, the strap body 32 may be constructed of an inelastic material. Furthermore, the securing strap 30 may include additional features (not shown), e.g., a forehead pad for additional stick and/or comfort, ornamental features, etc. or any other desired features known to those skilled in the art.

Figure 2:
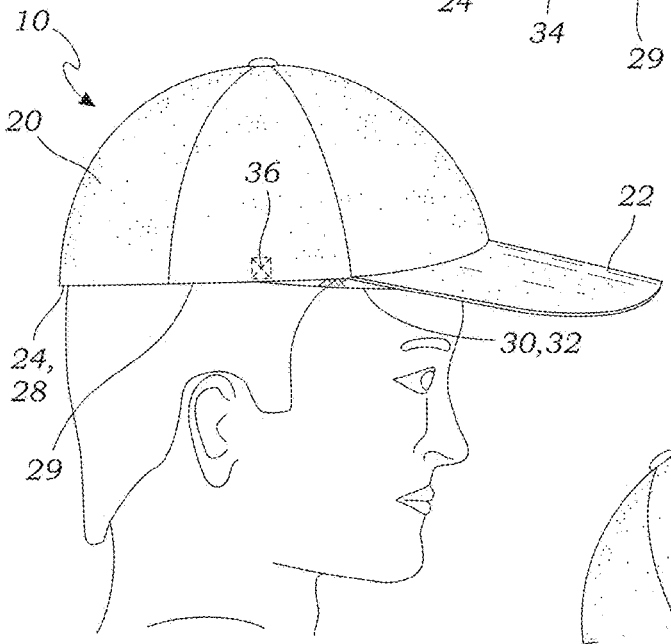
FIG. 2 is a side elevational view of the wind resistant cap being worn by a person during normal use.
Figure 3:
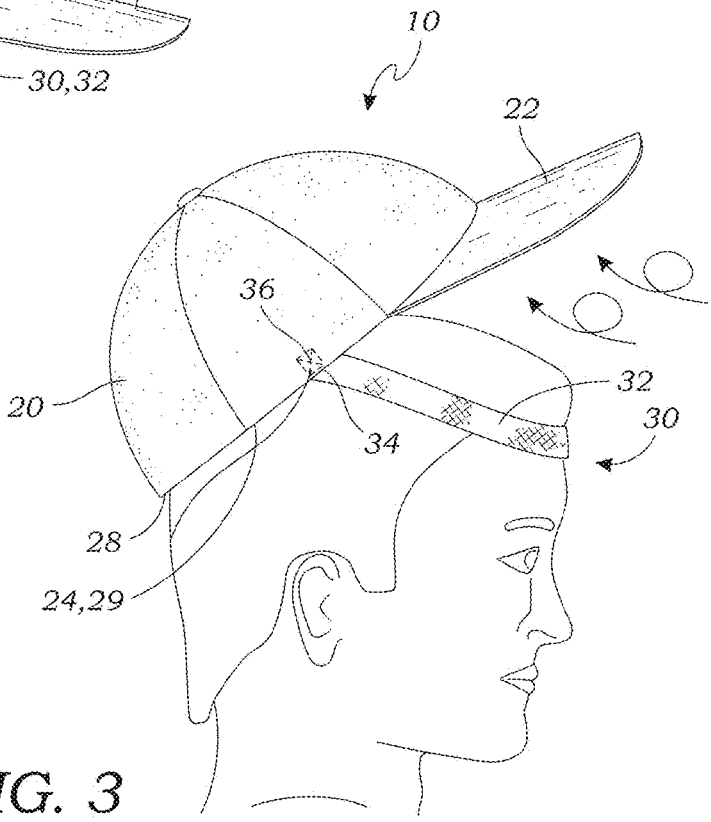
FIG. 3 is a side elevational view of the wind resistant cap being blown partially off the person's head, with the securing strap retaining the cap so it is not lost.

FIG. 2 is a side elevational view of the wind resistant cap 10 being worn by a person during normal use, and FIG. 3 is a side elevational view thereof, showing the cap body 20 being partially blown off the person's head with the securing strap 30 retaining the cap so it is not lost. As shown in FIGS. 2-3, when the cap body 20 is positioned on a head of a user, the strap body 32 is positioned across a forehead of the user, and such that if the cap body 20 is blown off the user's head, the securing strap 30 will retain the cap body 20 so that it is not lost.

Figure 4:
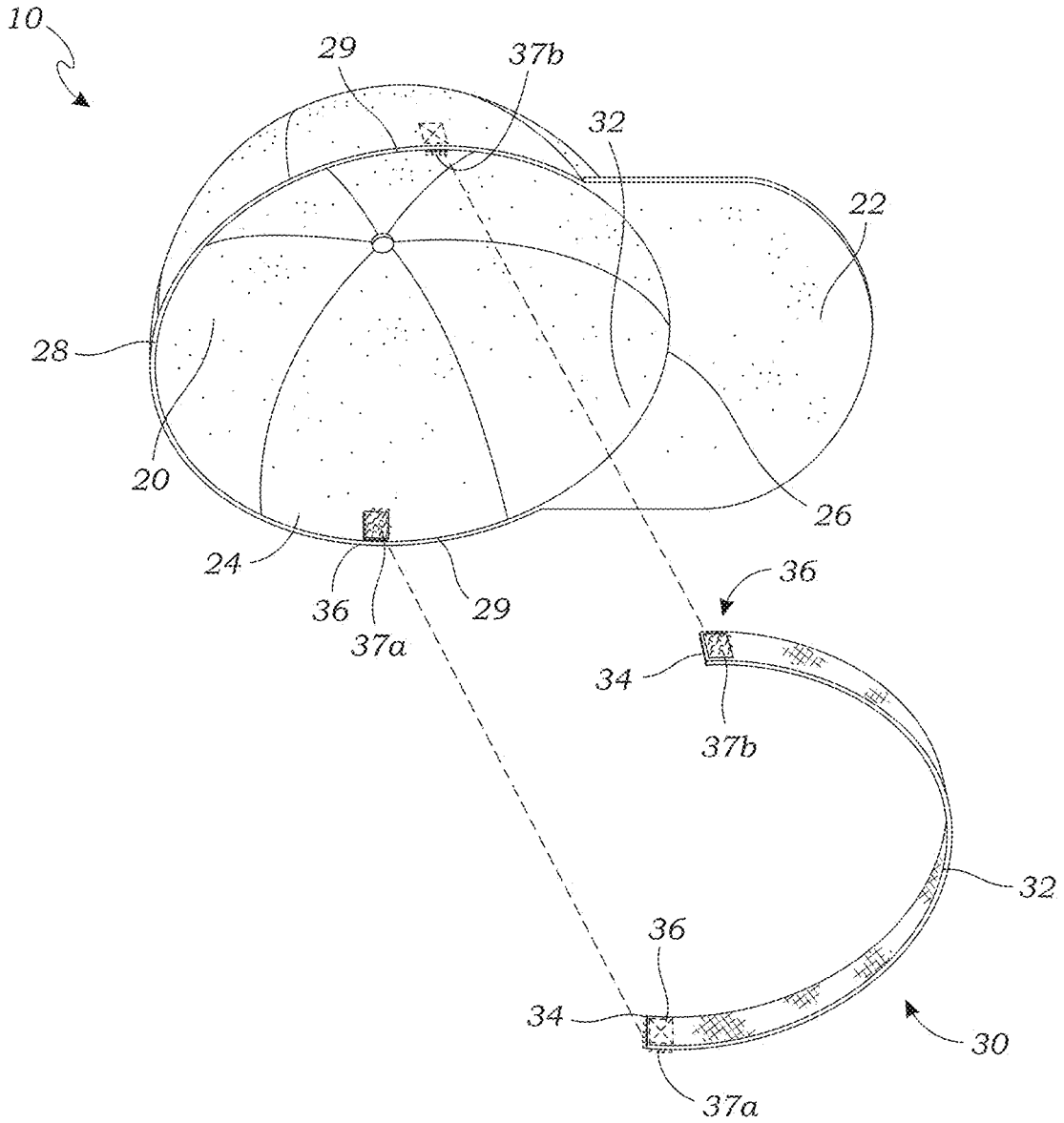
FIG. 4 is an exploded bottom perspective view of another embodiment of the wind resistant cap, showing the securing strap attached with a removable fastener.

FIG. 4 is an exploded bottom perspective view of another embodiment of the wind resistant cap 10, showing the securing strap 30 attached with a removable fastener 37 of the securing strap 30. As shown in FIG. 4, in this embodiment the fastener 37 of the securing strap 30 is in the form of a pair of first hook and loop strips 37*a* and 37*b*. One of the strips 37*a* is attached to the cap, and the other of the strips 37*b* is attached to the ends 34 of the securing strap 30.

In this manner, as described above, the securing strap 30 may be removably attached to the cap body 20, so the user may selectively use the securing strap 30 when desired. While one example of a removable fastener is shown and described, other removable fasteners may also be implemented, (e.g., snaps, single hooks, clips, etc.), provided the removable fastener does not come apart when encountering moderate wind resistance.

FIG. 5 is a bottom perspective view of a third embodiment of the wind resistant cap 10, showing an alternative securing strap 40. FIG. 6 is a side elevational view of a person wearing the wind resistant cap 10 of the FIG. 5, with the alternative securing strap 40 tightened around the person's head. As shown in FIGS. 5-6, in this embodiment, the securing strap 40 is in the form of a cord body 42 that extends to ends 44. Each of the ends 44 of the cord body 42 is attached to one of the opposing sides 29 of the inner circumference 24 of the cap body 20 via the fastener 36, in this case by passing through an aperture in the side of the cap. In this manner, the cord body 42 extends across the front portion 26 of the inner circumference 24 of the cap body 20, to abut the forehead of the user (or thereabouts).

As illustrated, in this embodiment, the fasteners 36 are in the form of a hole 46 formed in each of the opposing sides 29 of the cap body 20, wherein the securing strap 40 extends through each of the holes 46 to a middle cord portion 48. The opposing sides 29 may be folded such that the middle cord portion 48 is hidden, or the middle cord portion 48 may extend across the outside of the cap body 20. The middle cord portion 48 may further extend to a rear cord portion 49 that extends out of the rear portion 28 of the cap body to a connecting mechanism 50, in this embodiment a cord lock, but any connecting mechanism may be used (e.g., hook-and-loop strips, ties, clips, etc.).

In use, as shown in FIG. 6, the wearer may put on the cap 10 while the tightening mechanism 50 is loosened (FIG. 5), and then tighten as desired for comfort and security. The securing strap 40 should then function in the same manner as described for the embodiment of FIGS. 1-3 and 4. The securing strap 30 may also be used in combination with additional components such as a forehead pad, interior lining, or ornamental elements (not shown), as long as it maintains direct abutment with the front inner circumference and forehead as recited in the method. Thus, in practice, the method comprises providing a cap 10 as described, placing it on the user's head with the securing strap 30 aligned across the forehead, and resisting removal under wind conditions, wherein the strap 30 holds the cap 10 in place due to its fixed attachment and inelastic nature.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A method of securing a wind resistant cap on a head across a forehead of a user, the method comprising the steps of:

providing the wind resistant cap comprising a cap body and a brim extending outwardly from the cap body, the cap body having an inner circumference that includes a front portion adjacent the brim, a rear portion, and opposing sides; a securing strap having a strap body that extends to ends; wherein the securing strap is constructed of an inelastic material; and wherein-a first one of the ends of the strap body is stitched to a first one of the opposing sides of the inner circumference of the cap body, and a second one of the ends of the strap body is stitched to a second one of the opposing sides of the inner circumference of the cap body, such that the strap body extends entirely across the front portion of the inner circumference of the cap body, and an entirety of a width of the brim, and wherein the securing strap directly abuts the front portion of the inner circumference;

positioning the cap body on the head of the user, such that the strap body is positioned across the forehead of the user; and subjecting the wind resistant cap to sufficient wind to blow the cap body off the user's head, wherein the securing strap remains secured across the forehead of the user to retain the cap body so that the cap body is not blown entirely off the user's head.

* * * * *